US006972728B2

(12) United States Patent
Brown et al.

(10) Patent No.: US 6,972,728 B2
(45) Date of Patent: Dec. 6, 2005

(54) HORN ANTENNA WITH DYNAMICALLY VARIABLE GEOMETRY

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/626,090

(22) Filed: Jul. 24, 2003

(65) Prior Publication Data

US 2005/0017915 A1 Jan. 27, 2005

(51) Int. Cl.[7] ..... H01Q 13/00
(52) U.S. Cl. ..... 343/786
(58) Field of Search ..... 343/786, 785, 343/895, 771, 756, 772

(56) References Cited

U.S. PATENT DOCUMENTS

| | | | | | |
|---|---|---|---|---|---|
| 3,754,273 | A | | 8/1973 | Takeichi et al. | 343/786 |
| 3,943,521 | A | | 3/1976 | Phillips | 343/786 |
| 4,255,753 | A | * | 3/1981 | Lovick, Jr. | 343/786 |
| 4,783,665 | A | * | 11/1988 | Lier et al. | 343/786 |
| 5,162,972 | A | | 11/1992 | Gripshover et al. | 361/277 |
| 5,792,236 | A | | 8/1998 | Taylor et al. | 75/715 |
| 6,396,453 | B2 | * | 5/2002 | Amyotte et al. | 343/786 |
| 6,441,795 | B1 | * | 8/2002 | Volman | 343/786 |
| 6,512,496 | B2 | | 1/2003 | Alexeff et al. | 343/915 |
| 6,515,235 | B2 | | 2/2003 | Moller | 174/256 |
| 6,522,306 | B1 | * | 2/2003 | Parrikar et al. | 343/786 |
| 6,806,416 | B1 | | 10/2004 | Pike | 174/11 R |
| 2003/0160724 | A1 | | 8/2003 | Alexeff et al. | 343/701 |
| 2004/0095202 | A1 | | 5/2004 | Brown et al. | 333/35 |
| 2004/0095208 | A1 | | 5/2004 | Rawnick et al. | 333/156 |
| 2004/0124948 | A1 | | 7/2004 | Rawnick et al. | 333/174 |
| 2004/0125019 | A1 | | 7/2004 | Rawnick et al. | 343/700 MS |
| 2004/0130497 | A1 | * | 7/2004 | Alexeff et al. | 343/786 |
| 2004/0155727 | A1 | | 8/2004 | Rawnick et al. | 333/156 |
| 2004/0160382 | A1 | | 8/2004 | Rawnick et al. | 343/911 |
| 2004/0178865 | A1 | | 9/2004 | Rawnick et al. | 333/156 |
| 2004/0178869 | A1 | | 9/2004 | Brown et al. | 333/263 |
| 2004/0178966 | A1 | | 9/2004 | Rawnick et al. | 343/781 |
| 2004/0212464 | A1 | | 10/2004 | Rawnick et al. | 333/231 |
| 2004/0227690 | A1 | | 11/2004 | Rawnick et al. | 343/912 |
| 2004/0233023 | A1 | | 11/2004 | Pike | 333/246 |
| 2004/0239577 | A1 | | 12/2004 | Delgado et al. | 343/872 |
| 2004/0252058 | A1 | | 12/2004 | Rawnick et al. | 343/700 MS |
| 2004/0252069 | A1 | | 12/2004 | Rawnick et al. | 343/789 |
| 2005/0007209 | A1 | | 1/2005 | Brown et al. | 333/81 B |
| 2005/0017819 | A1 | | 1/2005 | Brown et al. | 333/81 B |
| 2005/0024167 | A1 | | 2/2005 | Rawnick et al. | 333/263 |
| 2005/0024629 | A1 | | 2/2005 | Pike et al. | 356/128 |

OTHER PUBLICATIONS

U.S. Appl. No. 10/330,756, filed Dec. 27, 2002, Rawnick et al.
U.S. Appl. No. 10/632,632, filed Aug. 1, 2003, Rawnick et al.
U.S. Appl. No. 10/625,977, filed Jul. 24, 2003, Rawnick et al.

(Continued)

*Primary Examiner*—Don Wong
*Assistant Examiner*—Ephrem Alemu
(74) *Attorney, Agent, or Firm*—Sacco & Associates, PA

(57) ABSTRACT

An electromagnetic horn antenna (100). The antenna can include a horn housing having a throat portion (102), a tapered portion (106, 104) and an aperture 108. At least one cavity structure (142, 144, 138) can be provided within the horn housing. The cavity structure can include at least one wall (138) formed of a dielectric material. A conductive fluid (136) and a fluid control system (103) can be provided. The fluid control system can control a volume and a position of the conductive fluid contained within the cavity structures for dynamically modifying at least one electrical characteristic of the electromagnetic horn antenna.

21 Claims, 3 Drawing Sheets

U.S. Appl. No. 10/614,149, filed Jul. 7, 2003, Brown et al.
U.S. Appl. No. 10/620,483, filed Jul. 16, 2003, Brown et al.
U.S. Appl. No. 10/640,237, filed Aug. 13, 2003, Rawnick et al.
U.S. Appl. No. 10/648,913, filed Aug. 27, 2003, Brown et al.
U.S. Appl. No. 10/414,695, filed Apr. 16, 2003, Rawnick et al.
U.S. Appl. No. 10/460,947, filed Jun. 13, 2003, Rawnick et al.
U.S. Appl. No. 10/421,305, filed Apr. 23, 2003, Rawnick et al.
U.S. Appl. No. 10/648,887, filed Aug. 27, 2003, Rawnick et al.
U.S. Appl. No. 10/439,094, filed May 15, 2003, Rawnick et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/635,582, filed Aug. 6, 2003, Rawnick et al.
U.S. Appl. No. 10/634,219, filed Aug. 5, 2003, Rawnick et al.

* cited by examiner

HORN ANTENNA WITH DYNAMICALLY VARIABLE GEOMETRY

BACKGROUND OF THE INVENTION

1. Statement of the Technical Field

The inventive arrangements relate generally to methods and apparatus for horn antennas, and more particularly to horn antennas that can be dynamically modified to enhance performance at selected operating frequencies.

2. Description of the Related Art

Conventional electromagnetic horn antennas are well known in the art. Horn antennas are essentially open-ended waveguides in which the dimensions are gradually flared outwardly toward the radiating aperture. Increasing the length of the horn and the flare of the horn can produce highly directive radiation patterns. However, because conventional horns are generally designed to have a static geometry, the directivity of the radiation pattern is largely predetermined and cannot be varied dynamically.

Corrugated electromagnetic horn antennas are also well known in the art. Such horns are typically "corrugated" on an inner surface of the horn so as to define a number of transverse ribs spaced apart by grooves or "slots". As there are typically at least two corrugations per wavelength, the total number of corrugations in any given horn is usually relatively large.

Corrugated horn antenna offer many desirable features. In particular, the corrugations change the fields propagating within the horn so as to provide axial beam symmetry, low sidelobes and low cross-polarization. However, due to the critical nature of the geometry associated with the corrugations, the useful bandwidth of the corrugated horn is typically relatively narrow. Accordingly, the usefulness of these types of antennas can be somewhat limited.

Design considerations for corrugated horn antennas, particularly for those with relatively large apertures, typically suggest quarter wavelength deep corrugations and many corrugations per wavelength. This geometry is usually selected to give the lowest possible amount of cross-polarization at a center frequency for the design. For smaller horn diameters, the optimal depth of the corrugations tends to increase so that the corrugations are somewhat deeper that one quarter wavelength. Similarly, if there are fewer corrugations per wavelength, deeper corrugations may be desirable. Regardless however of the exact dimensions of the corrugations, conventional designs are generally limited by the static nature of the geometry.

Further, within the throat region of the horn it is important to modify the corrugation depth to provide an efficient impedance match to the smooth-wall portion of the feed or horn. In order to accomplish the foregoing, it has been found that the slot corresponding to the first corrugation is advantageously about one half wavelength deep. Thereafter, the depths of the several slots following can be tapered down to the standard depth of approximately one quarter wavelength.

Significantly, a corrugated horn that has been optimized for operation at a particular center frequency will exhibit poorer performance as the frequency is varied away from that center frequency. This deterioration in performance can be attributed to the variation in wavelength that naturally occurs with changes in frequency which result in non-optimized corrugation geometries.

SUMMARY OF THE INVENTION

The invention concerns a method for modifying at least one electrical characteristic of a horn antenna. The method can include configuring the horn antenna in a first operating mode in which the horn antenna has at least a first electrical characteristic. Subsequently, the method can include selectively changing at least one of a volume and a location of a conductive fluid contained within the horn antenna to produce at least a second operating mode in which the horn antenna has at least a second electrical characteristic different from the first electrical characteristic. The volume or position of the conductive fluid can be controlled using a series of one or more valves, pumps, actuators, conduits and sensors.

The step of selectively changing the volume or location of the conductive fluid can further comprise selectively varying a profile of at least one conductive inner surface of the horn antenna, varying a position of at least one conductive surface of the horn antenna, changing a flare angle of the horn antenna and changing at least one internal dimension of a throat region of the horn antenna, changing a corrugation geometry of the horn antenna, and changing an aperture diameter of the horn antenna.

The electrical characteristic modified by the movement of conductive fluid can include an input impedance, a radiation pattern, a gain, and an antenna beamwidth.

According to another aspect, the invention can include an electromagnetic horn antenna. The antenna can include a horn housing having a throat portion, a tapered portion and an aperture. At least one cavity structure can be provided within the horn housing. The cavity structure can include at least one portion formed of a dielectric material.

Further, a conductive fluid and a fluid control system can be provided. The fluid control system can be configured to selectively control at least one of a volume and a position of the conductive fluid contained within the one or more cavity structures for dynamically modifying at least one electrical characteristic of the electromagnetic horn antenna. According to one aspect of the invention, an interior surface of the horn housing can be corrugated so as to define a series of ribs axially spaced along a length of the horn housing and defining a plurality of slots. In that case, the cavity structure can be at least partially comprised of the ribs. The plurality of ribs can be formed of a conductive material or a dielectric material depending upon the particular design. At least one portion of the cavity structure can be defined by an annular dielectric wall extending between adjacent ones of the ribs.

The electrical characteristic to be modified can be selected without limitation from the group consisting of an input impedance, a radiation pattern, a gain, and an antenna beamwidth. In this regard, the control system can be used to control the volume and/or position of the conductive fluid to change a flare angle of the horn antenna, an internal dimension of the horn antenna, a corrugation geometry of the horn antenna and an aperture diameter of the horn antenna. The control system can also be used to control the conductive fluid to convert an inner conductive surface of the horn antenna from a smooth profile to a corrugated profile.

DETAILED DESCRIPTION OF THE PREFERRED EMBODIMENTS

The present invention concerns electromagnetic horn antennas that can be dynamically modified to alter their operating characteristics. For example, using the techniques described herein, the horns can be modified for operation on different frequencies, to produce different radiation patterns, or to change their input impedance.

According to one embodiment of the invention, a corrugated electromagnetic horn antenna can be dynamically modified to have variable characteristics. For example, the antenna can be shifted from a first operational band of frequencies to at least a second operational band of frequencies, or the antenna pattern can be modified.

Figure 1:
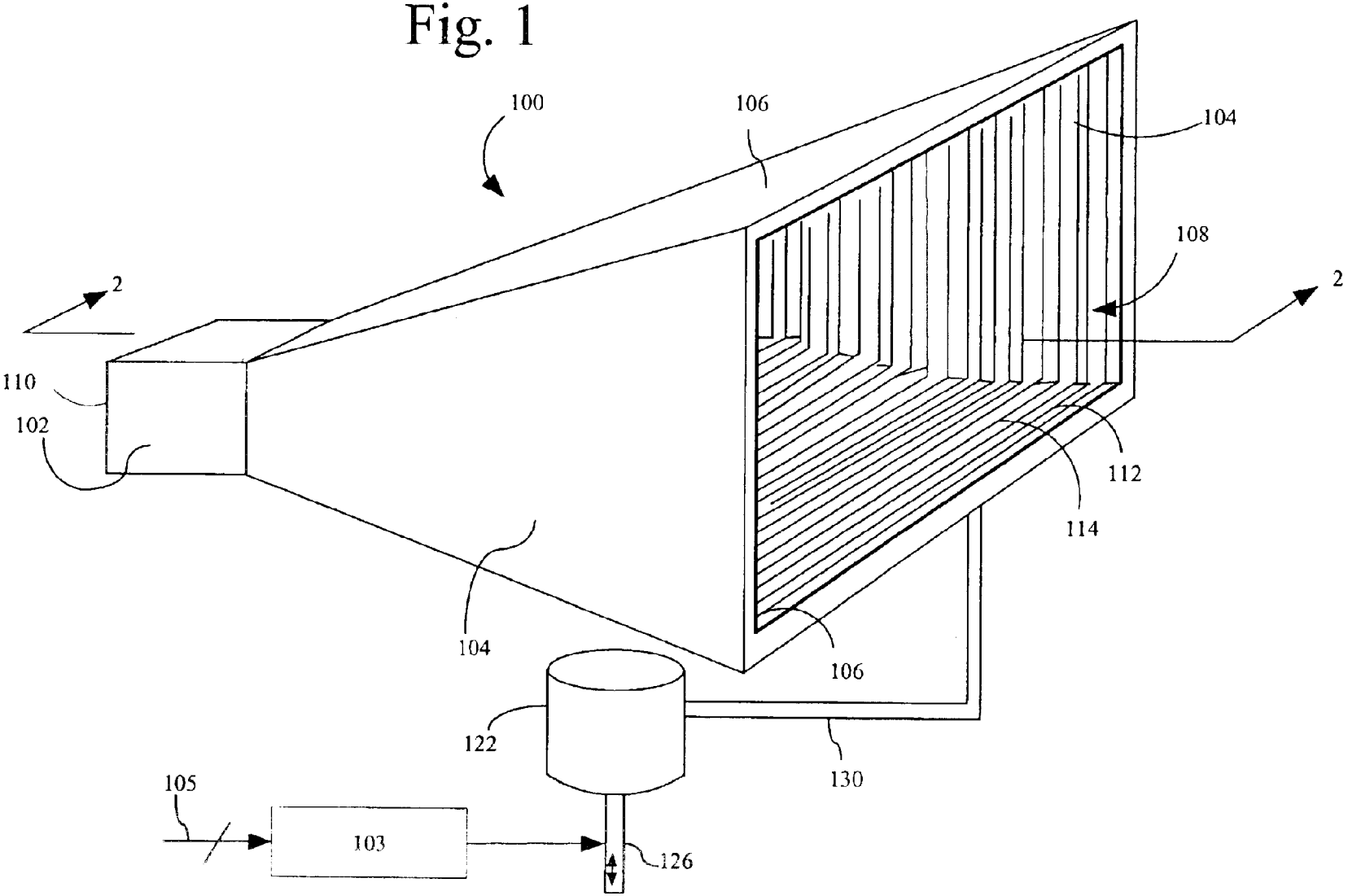
FIG. 1 is a perspective view of a horn antenna that is useful for understanding the present invention.

FIG. 1, is a perspective drawing illustrating a corrugated horn antenna 100 that is useful for understanding the invention. As shown therein, the corrugated horn 100 is of the pyramidal type, but it should be appreciated that the invention is not so limited, Instead, the invention can be implemented in any type of rectangular or conical horn antenna.

The corrugated horn 100 is comprised of a housing that can include a throat portion 102 that is typically dimensioned for operating as a waveguide, and an aperture 108 disposed an opposite end of the horn, opposed to the throat portion. The horn also includes vertical sidewalls 104 and horizontal sidewalls 106 that together form a flared or tapered section of the horn. In accordance with conventional waveguide designs, at least an interior surface of the horn defined by the horizontal and vertical sidewalls 104, 106 can be formed of an electrically conductive material. The horn can also have a variety of different flare angles and lengths, depending upon the gain and beamwidth needed in a particular application.

In the present embodiment, an interior surface of the horn is corrugated so as to define a number of transverse ribs 112 spaced apart by slots 114. The ribs are preferably annular in nature and conform to the profile defined by the interior of the corrugated horn 100. For example, the ribs 112 can, without limitation, define a rectangular, square or round area depending upon the type of horn. In FIG. 1, the ribs would have essentially a rectangular profile as shown in FIG. 1 to conform to the interior shape of the horn.

According to one embodiment, the ribs and slots can be formed of a conductive material. Further in a preferred embodiment, there can be at least two corrugations per wavelength. However, the invention is not so limited and more or fewer corrugations can also be used. Further, the corrugations defined by ribs 112 and slots 114 are preferably about a quarter wavelength deep.

The above-described horn corrugation geometry is commonly selected in a corrugated horn to give the lowest possible amount of cross-polarization at a center frequency for the design. However, those skilled in the art will appreciate that the invention is not so limited. For example, in the case of smaller horn diameters, the optimal depth of the corrugations tends to increase so that the corrugations are somewhat deeper than one quarter wavelength. Similarly, if there are fewer corrugations per wavelength, deeper corrugations may be desirable for a particular design frequency.

Figure 2:
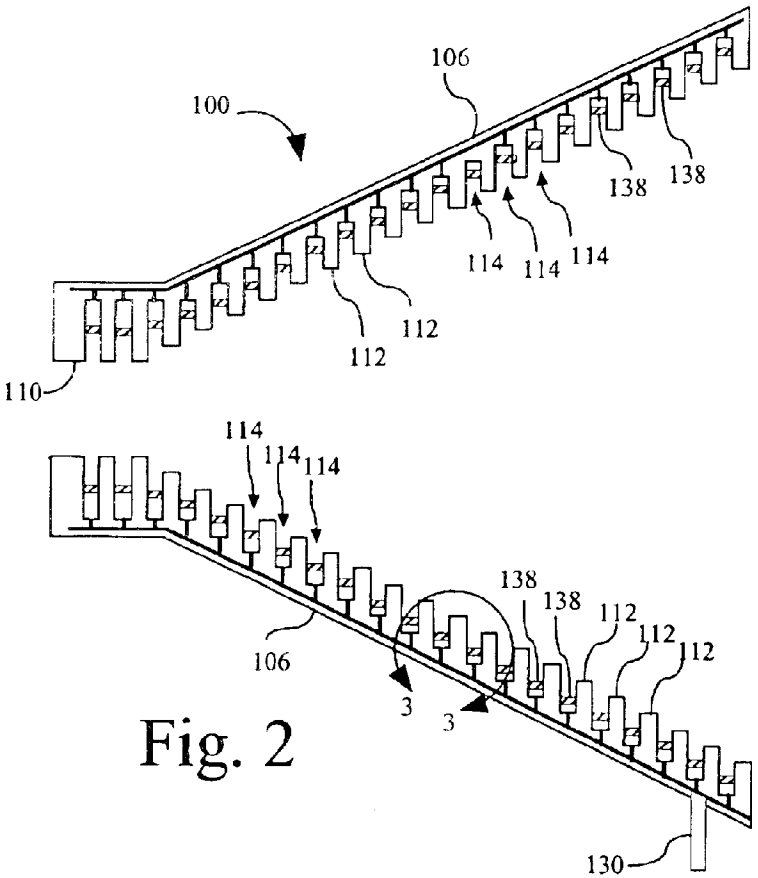
FIG. 2 is a cross-sectional view of the horn antenna of FIG. 1 taken along line 2—2.

A suitable feed structure 110 is preferably provided for exciting the horn waveguide as shown. For example, the horn 100 can be configured as illustrated in FIG. 2 for mounting to a waveguide feed (not shown). However, the invention is not limited to any particular feed structure. Instead, any one of a wide variety of common horn antenna feed configurations are possible.

At least one fluid reservoir 122 that is preferably provided in fluid communication with fluid channel 134 of the horn antenna by way of conduit section 130. The fluid reservoir 122 can contain a conductive fluid 136. Fluid actuator 126 can be provided for selectively controlling the movement of the conductive fluid 136 into and out of the fluid channel 134. For example, the fluid actuator can include a hydraulic piston that is contained within a cylinder defined by the fluid reservoir 122. Alternatively, the fluid actuator can comprise any other type of pump device. The fluid actuator can be controlled manually or, in a preferred embodiment, can be operated automatically in response to a control signal. In that case, the fluid actuator can be operated by an appropriate electro-mechanical, pneumatic, or hydraulic device. For example a remotely operated stepper motor or electric solenoid could be used for this purpose. In any case, the foregoing devices can be operated by means of a suitable control signal appropriate for the device.

Figure 3:
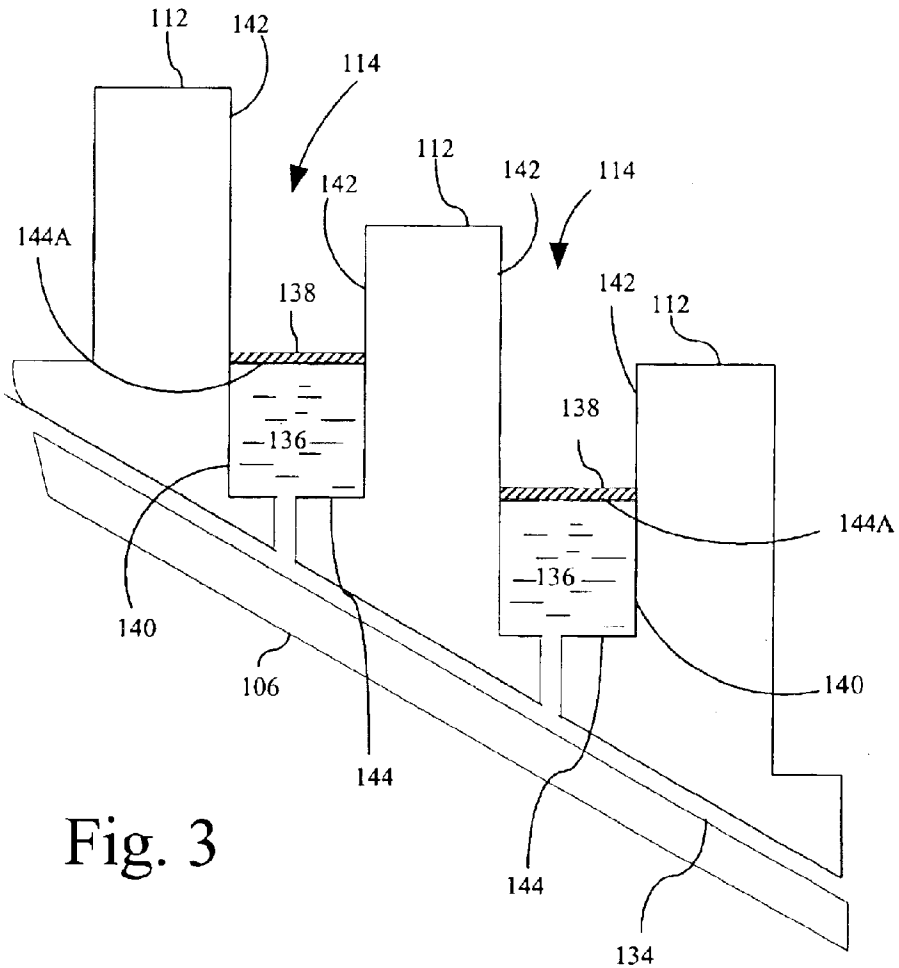
FIG. 3 is an enlarged cross-sectional view of the horn antenna in FIG. 2

Referring now to FIGS. 2 and 3, it can be seen that the fluid channel 134 is in fluid communication with a plurality of annular cavities 140 that are defined by a cavity structure. In FIGS. 2 and 3, the cavity structure includes ribs 112 and annular dielectric walls 138, however, the invention is not so limited. In any case, when fluid actuator 126 is operated, it can cause conductive fluid 136 to be forced under pressure into the annular cavities 140. Pressure relief conduits (not shown) can be provided to allow any volume of gas contained within the annular cavities 140 to be vented so as to accommodate the addition or removal of conductive fluid. The actuator 126 can also be operated to create a reduced pressure so as to draw fluid out of the annular cavities, back into the channel 134, and into the reservoir 122.

The annular dielectric walls 138 are preferably formed of a material that has a permittivity and permeability generally consistent with the permittivity and permeability of the space inside the horn. For example, if the interior of the horn is open to the air, then the annular dielectric walls 138 can have a permittivity and permeability equal to approximately one. Accordingly, when the conductive fluid 136 is not present in the annular cavities 140, the corrugated horn 100 behaves as a conventional corrugated horn antenna and the annular dielectric walls 138 have no practical effect on the RF propagating within the horn provided that they have a relatively low loss tangent. More particularly, the slots will be free of conductive fluid and will have a physical and electrical depth defined by the full extent of the conductive walls 142, 144 of the slot 114. This depth can correspond, for example, to a quarter wavelength at a first operational frequency of the horn.

Conversely, when the conductive fluid 136 is forced into the annular cavities 140, then the slots 114 can appear to have a lesser depth. More particularly, the depth of the slot can appear to move from wall 144 to surface 144A, which is the interface between the conductive fluid and the annular dielectric wall 138. This depth can correspond, for example, to a quarter wavelength at a second operational frequency of the horn that is higher than the first operational frequency. By tailoring the depth of the slots 114 for each of the first and second operational frequencies, the corrugated horn antenna 100 can be optimized at each of the operational frequencies. For example, the corrugation depths can be optimized to produce the lowest possible amount of cross-polarization at each of the operational frequencies.

According to an alternative embodiment, ribs 112 can be formed of a dielectric material instead of a conductive material. If the dielectric material has a permittivity and permeability that is approximately equal to the environment within the corrugated horn 100 (and a low loss tangent), then such corrugations can appear to be invisible for all practical purposes to RF propagating within the horn. Accordingly, when there is no conductive fluid 136 contained within the cavities 140, the interior surface of the horn defined by wall 106 can appear smooth. Conversely, when conductive fluid is added to the cavities 140, the conductive fluid 136 will effectively form conductive fluid ribs separated by a gap defined by the dielectric ribs 112. In this way, the horn antenna 112 can be quickly switched from operation as a conventional horn to a corrugated horn and vice versa.

Those skilled in the art will appreciate that using a conductive fluid and cavity structures as described herein, the invention can be effectively used to modify essentially any internal dimension of a horn antenna and the invention is intended to cover all such embodiments. As used herein, the term internal dimension refers to the size, profile or shape of any surface within an electromagnetic horn housing that can potentially be used to modify an electrical or performance characteristic of a horn antenna.

Figure 4:
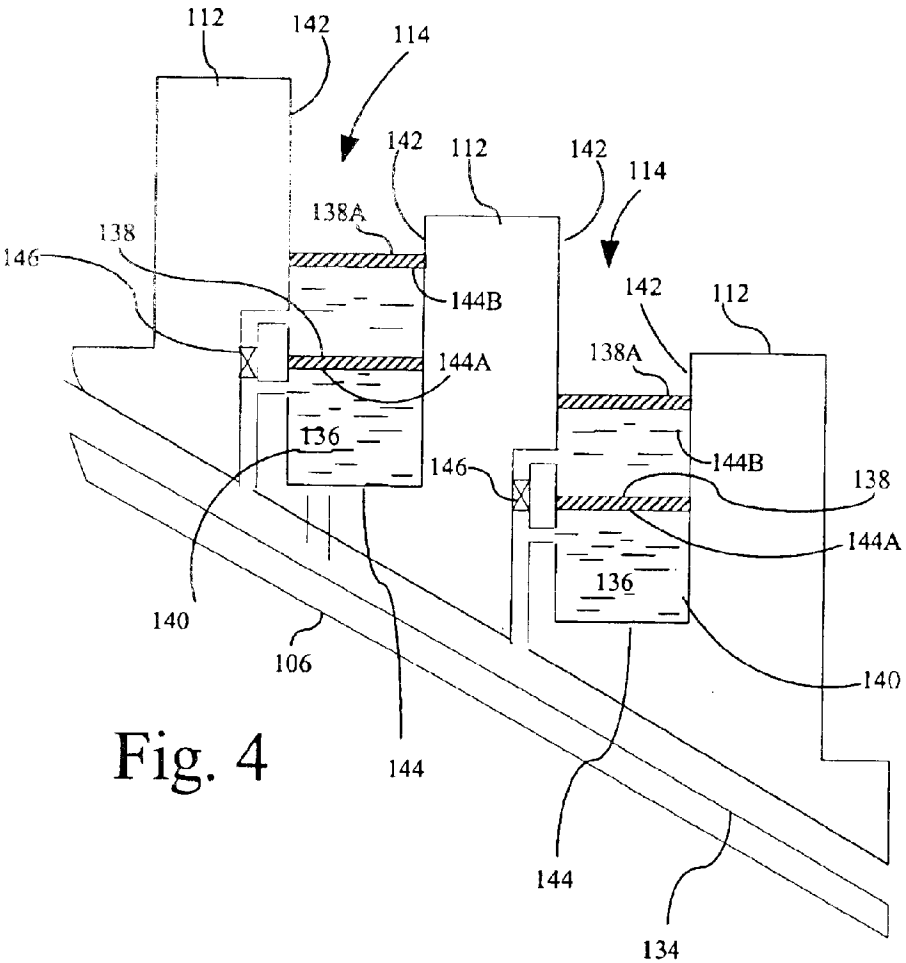
FIG. 4 is an enlarged cross-sectional view of an alternative embodiment of the horn antenna in FIG. 3.

FIG. 4 is an alternative embodiment of the corrugated wall structure in FIGS. 2 and 3 that shows how additional optimized operational frequencies can be achieved. More particularly, a plurality of annular dielectric walls 138, 138A can be provided to define a plurality of annular cavities in each slot 114. At least one of the slots can be controlled by a valve 146 to selectively determine the slot depth. Consequently, by varying the position of the conductive fluid 136, the depth of the slot can be dynamically varied from wall 144, to surface 144A and surface 144B.

Further, the number of slots can appear to be varied by alternately filling certain of the slots 114 with conductive fluid while leaving other slots devoid of such conductive fluid. Those skilled in the art will appreciate that a wide variety of internal slot configurations can be achieved using this technique and the invention is not limited to any particular arrangement. Instead, many other electrical characteristics of the corrugated horn antenna can be modified using similar techniques. For example, the invention can include dynamically modifying the flare angle of a horn antenna as shown in FIG. 5.

Figure 5:
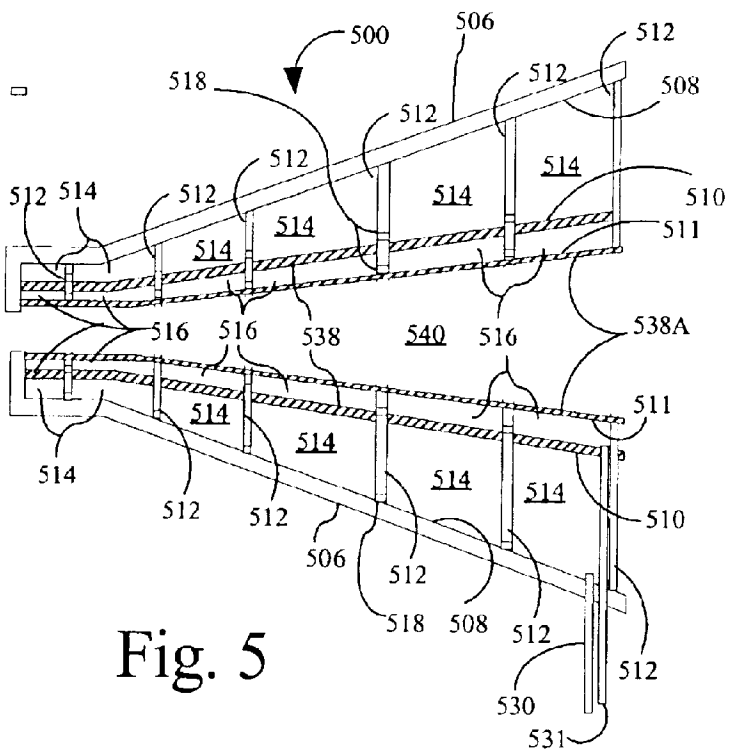
FIG. 5 is a cross-sectional view of a second alternative embodiment of a horn antenna.

In FIG. 5, a cross-sectional view of a horn antenna 500 is shown in which the transverse ribs 512 define slots or cavities 514, 516. The transverse ribs in this instance are preferably formed of a dielectric material rather than a conductive material. Likewise, annular walls 538, 538A are formed of a dielectric material. The dielectric material can preferably have a permittivity and a permeability that is approximately consistent with the internal space defined by the horn antenna. For example, if the internal space 540 of the antenna is normally filled with air, the relative permittivity and permeability can be selected to be equal to one. Consequently, if the loss tangent of the dielectric material is low, then the dielectric ribs and walls can have only a minimal effect on the operation of the horn 500 when the cavities 514, 516 are also filled with air or some other inert gas. The outer walls 506 of the antenna can be formed of a conductive material such as aluminum or brass.

According to a preferred embodiment, the annular walls 538, 538A and the ribs 512 can define a plurality of cavities 514, 516. Fluid conduits 530, 531 can be used to add and remove conductive fluid from the fluid cavities 514, 516, respectively. According to one embodiment, the plurality of cavities 514 can be in fluid communication with one another through a series of passageways 518 so that a conductive fluid injected by fluid conduit 530 can completely fill the annular space defined by the plurality of cavities 514. The result is that the inner conductive surfaces of the horn can appear to be moved from surface 508 to surface 510. Similarly, by adding conductive fluid to the plurality of cavities 516 using conduit 531, the inner conductive surfaces of the horn can appear to be moved to surface 511. The cavities 516 can be similarly in fluid communication with one another by means of passageways 518.

According to a preferred embodiment, conduits 530, 531 can be positioned at the lowest anticipated point in each set of cavities 514, 516 so that conductive fluid can drain freely when necessary. If this position within the horn 500 places the conduits in a location that could potentially interfere with the operation of the horn, then the conduits can be formed of a dielectric material that is approximately matched to the permittivity and permeability of the environment within the horn. Consequently, the conduits can avoid any interaction with RF propagating within the interior 540 of the horn. Of course, many other horn orientations are also possible and so it may be desirable to include more than one set of conduits 530, 531 in various locations for adding and removing fluid as necessary in a particular application. In any case, the selection of conduit location and plumbing for the purpose of adding and removing conductive fluid is a matter of design choice. Accordingly, the invention is not limited to any particular arrangement provided that the conductive fluid can be effectively added and removed from the cavities as may be needed.

Further, those skilled in the art will appreciate that the profile of the annular walls 538, 538A in FIG. 5 merely represent one possible embodiment of the invention. In fact, the profile of the annular walls can be selected to produce any interior profile of the horn. The annular walls 538, 538A and ribs 512 can be selected so as to have any profile that may be advantageous to dynamically modify the characteristics of the horn. For example, the annular walls and ribs can be selected so as to dynamically modify one or more of a throat region of the horn (e.g., to control input impedance), a flare angle/profile (e.g., to control the radiation pattern), and an aperture diameter (e.g., to control the beamwidth). More or fewer ribs and/or annular walls can be provided as necessary to implement a particular design and the invention is not limited to any particular number of ribs, annular walls, or cavities.

Further, using suitable control valves and fluid control circuitry (not shown), selected ones of cavities 514, 516 can be filled with conductive fluid whereas other cavities 514, 516 can be left devoid of fluid so as to control the profile of the interior conductive surface of the horn 500. For example, if only alternate cavities are filled with conductive fluid then the interior of the horn can appear to have an inner conductive surface that defines a corrugated profile. In that case, it can be desirable to include more ribs 512 to define the pattern of slots that are desired for a particular corrugated horn application. In any case, if individual fluid cavities 514, 516 are to be independently controlled by the injection and purging of conductive fluid, then the fluid conduits 518 can be omitted so that conductive fluid injected in one cavity 514, 516 does not automatically fill adjacent cavities 514, 516.

Finally, it should be noted that while the invention has been described herein in relation to pyramidal horn antennas as shown in FIGS. 1–5. However, the invention is not limited to any particular horn profile. Instead, the inventive concepts as described herein can be applied without limitation to any profile including but not limited to square, rectangular or conical profile antennas.

Conductive Fluid

According to one aspect of the invention, the conductive fluid used in the invention can be selected from the group consisting of a metal or metal alloy that is liquid at room temperature. The most common example of such a metal would be mercury. However, other electrically-conductive, liquid metal alloy alternatives to mercury are commercially available, including alloys based on gallium and indium alloyed with tin, copper, and zinc or bismuth. These alloys, which are electrically conductive and non-toxic, are described in greater detail in U.S. Pat. No. 5,792,236 to Taylor et al, the disclosure of which is incorporated herein by reference. Other conductive fluids include a variety of solvent-electrolyte mixtures that are well known in the art.

A system which relies on the presence or absence of a conductive fluid can also include some means to ensure that no conductive residue remains in/on the walls of the fluid cavities when the antenna is purged of conductive fluid. In this regard, the cavities containing conductive fluid can be flushed with a suitable solvent after the conductive fluid has been otherwise purged. This flushing can be performed manually or by an automated system. For example, in the case of conductive fluids which may consist of particles in solution or suspension, an active purging system (not shown) may be employed which uses a non-conductive fluid to flush the cavities of any remaining conductive particles.

Fluid Control System

As noted above, the invention described herein with regard to FIGS. 1–5 preferably includes a fluid control system. The fluid control system can be manually operated or can be responsive to a control signal for selectively changing the internal configuration of the horn antenna as described herein. The fluid control system can be provided for moving any volume of conductive fluid 136 contained in a reservoir 122 to and from any selected cavity structures associated with the horn antennas 100, 500 as described herein. The fluid control system can comprise any combination of pumps, fluid actuators 126, valves 146, conduits 130, 530, 531 and sensors (not shown) useful for selectively varying a volume of fluid in the cavity structures in response to a control signal. Notably, the pumps, actuators, and valves described herein can be of the conventional miniature variety or can be formed as micro electro-mechanical devices.

The fluid control system can also include an electronic controller 103 for selectively controlling the various components of the fluid control system in response to a control signal 105. However, the various pumps, valves and fluid actuators can also be operated manually. Significantly, the invention is not limited to the precise fluid control arrangements shown in FIGS. 1–5, and those skilled in the art will readily appreciate that numerous alternative arrangements, both manual and automated, are also possible. Accordingly, any arrangement of conduits, pumps, valves, sensors and control circuitry can be used for this purpose as would be appreciated by one of ordinary skill in the art, the embodiments shown herein being merely by way of example.

We claim:

1. A method for modifying at least one electrical characteristic of a horn antenna, comprising the steps of:

configuring said horn antenna in a first operating mode in which said horn antenna has at least a first electrical characteristic; and selectively changing at least one of a volume and a location of a conductive fluid contained within said horn antenna to produce at least a second operating mode in which said horn antenna has at least a second electrical characteristic different from said first electrical characteristic; and wherein said selectively changing step further comprises changing a flare angle of said horn antenna.

2. A method for modifying at least one electrical characteristic of a horn antenna, comprising the steps of:

configuring said horn antenna in a first operating mode in which said horn antenna has at least a first electrical characteristic; and selectively changing at least one of a volume and a location of a conductive fluid contained within said horn antenna to produce at least a second operating mode in which said horn antenna has at least a second electrical characteristic different from said first electrical characteristic; and wherein said selectively changing step further comprises changing at least a corrugation geometry of said horn antenna.

3. An electromagnetic horn antenna comprising:

a horn housing having a throat portion, a tapered portion and an aperture;

at least one cavity structure defined within said horn housing, said cavity structure comprising at least one portion formed of a dielectric material;

a conductive fluid and a fluid control system, said fluid control system selectively controlling at least one of a volume and a position of said conductive fluid contained within said at least one cavity structure for dynamically modifying at least one electrical characteristic of said electromagnetic horn antenna; and wherein said control system controls said volume of said conductive fluid to change a flare angle of said horn antenna.

4. An electromagnetic horn antenna comprising:

a horn housing having a throat portion, a tapered portion and an aperture;

at least one cavity structure defined within said horn housing, said cavity structure comprising at least one portion formed of a dielectric material;

a conductive fluid and a fluid control system, said fluid control system selectively controlling at least one of a volume and a position of said conductive fluid contained within said at least one cavity structure for dynamically modifying at least one electrical characteristic of said electromagnetic horn antenna; and wherein said control system controls said conductive fluid to change at least a corrugation geometry of said horn antenna.

5. An electromagnetic horn antenna comprising:

a horn housing having a throat portion, a tapered portion and an aperture;

at least one cavity structure defined within said horn housing, said cavity structure comprising at least one portion formed of a dielectric material;

a conductive fluid and a fluid control system, said fluid control system selectively controlling at least one of a volume and a position of said conductive fluid contained within said at least one cavity structure for dynamically modifying at least one electrical characteristic of said electromagnetic horn antenna; and wherein said control system controls said conductive fluid to convert an inner conductive surface of said horn antenna from a smooth profile to a corrugated profile.

6. A method for modifying at least one electrical characteristic of a horn antenna, comprising the steps of:

configuring said horn antenna in a first operating mode in which said horn antenna has at least a first electrical characteristic; and selectively changing at least one of a volume and a location of a conductive fluid contained in at least one cavity having a fixed position within said horn antenna to produce at least a second operating mode in which said horn antenna has at least a second electrical characteristic different from said first electrical characteristic.

7. The method according to claim 6 wherein said selectively changing step further comprises changing at least an aperture diameter of said horn antenna.

8. The method according to claim 6 wherein said electrical characteristic is selected from the group consisting of an input impedance, a radiation pattern, a gain, and an antenna beamwidth.

9. The method according to claim 6 wherein said selectively changing step further comprises controlling at least one of a valve, a pump and a fluid actuator.

10. The method according to claim 6 wherein said selectively changing step further comprises selectively varying a profile of at least one conductive inner surface of said horn antenna.

11. The method according to claim 6 wherein said selectively changing step further comprises selectively varying a position of at least one conductive surface of said horn antenna.

12. The method according to claim 6 wherein said selectively changing step further comprises changing at least one internal dimension of a throat region of said horn antenna.

13. An electromagnetic horn antenna comprising:

a horn housing having a throat portion, a tapered portion and an aperture;

at least one cavity structure defined at a fixed position within said horn housing, said cavity structure comprising at least one portion formed of a dielectric material;

a conductive fluid and a fluid control system, said fluid control system selectively controlling at least one of a volume and a position of said conductive fluid contained within said at least one cavity structure for dynamically modifying at least one electrical characteristic of said electromagnetic horn antenna.

14. The electromagnetic horn antenna according to claim 13 wherein an interior surface of said housing is corrugated so as to define a series of ribs axially spaced along a length of said horn housing and defining a plurality of slots.

15. The electromagnetic horn antenna according to claim 13 wherein said at least one portion of said cavity structure is an annular dielectric wall extending between adjacent ones of said ribs.

16. The electromagnetic horn antenna according to claim 13 wherein said at least one electrical characteristic is selected from the group consisting of an input impedance, a radiation pattern, a gain, and an antenna beamwidth.

17. The electromagnetic horn antenna according to claim 13 wherein said control system controls said conductive fluid to change at least an aperture diameter of said horn antenna.

18. The electromagnetic horn antenna according to claim 13 wherein said control system controls said conductive fluid to change at least one internal dimension of said horn antenna.

19. The electromagnetic horn antenna according to claim 13 wherein said at least one cavity structure is at least partially comprised of said ribs.

20. The electromagnetic horn antenna according to claim 19 wherein at least one of said plurality of ribs is formed of a conductive material.

21. The electromagnetic horn antenna according to claim 19 wherein at least one of said plurality of ribs is formed of a dielectric material.

* * * * *